US010240538B2

(12) United States Patent
Noma

(10) Patent No.: US 10,240,538 B2
(45) Date of Patent: Mar. 26, 2019

(54) MULTI-CYLINDER ENGINE AND OUTBOARD MOTOR

(71) Applicant: YAMAHA HATSUDOKI KABUSHIKI KAISHA, Iwata-shi, Shizuoka (JP)

(72) Inventor: Akihiro Noma, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 384 days.

(21) Appl. No.: 15/042,182

(22) Filed: Feb. 12, 2016

(65) Prior Publication Data

US 2016/0341164 A1 Nov. 24, 2016

(30) Foreign Application Priority Data

May 20, 2015 (JP) ..... 2015-102667

(51) Int. Cl.

| | |
|---|---|
| ***F02D 1/00*** | (2006.01) |
| ***F02B 61/04*** | (2006.01) |
| ***F02M 59/36*** | (2006.01) |
| ***F02M 59/10*** | (2006.01) |
| ***F02D 41/38*** | (2006.01) |
| ***F02D 41/00*** | (2006.01) |
| ***F02M 63/02*** | (2006.01) |
| ***F02B 75/00*** | (2006.01) |

(Continued)

(52) U.S. Cl.

CPC ..... *F02D 1/00* (2013.01); *F02B 61/045* (2013.01); *F02B 75/007* (2013.01); *F02B 75/22* (2013.01); *F02D 41/3818* (2013.01); *F02D 41/3845* (2013.01); *F02M 59/102* (2013.01); *F02M 59/366* (2013.01); *F02M 59/368* (2013.01); *F02M 63/0295* (2013.01); *B63H 20/00* (2013.01); *B63H 20/14* (2013.01); *F02D 41/0082* (2013.01); *F02D 2001/0085* (2013.01)

(58) Field of Classification Search

CPC ..... F02D 41/3845; F02D 2041/3881; F02D 2200/0602; Y02T 10/44; F02B 75/22; F02B 61/045; F02B 37/12; F02B 2075/1832; F02M 21/0245; F02M 63/0295; F02M 63/0285; F02M 63/024; F02M 59/368; F02M 37/04; F02M 37/06; F02M 37/041

USPC ..... 123/499, 500, 501

See application file for complete search history.

(56) References Cited

U.S. PATENT DOCUMENTS 4,100,903 A * 7/1978 Roosa ..... F02D 1/12 123/502

6,321,711 B1 * 11/2001 Kato ..... F02B 61/045 123/195 A (Continued)

FOREIGN PATENT DOCUMENTS

JP 11101168 A * 4/1999 ..... F03B 37/02

JP 11101168 A * 4/1999 ..... F02B 37/02

(Continued)

*Primary Examiner* — Sizo B Vilakazi

*Assistant Examiner* — Brian R Kirby

(74) *Attorney, Agent, or Firm* — Keating and Bennett, LLP

(57) ABSTRACT

A multi-cylinder engine includes a plurality of cylinders that are fired at uneven intervals. A controller is configured or programmed to overlap a time period that a plunger increases a pressure in a pressurizing chamber and a time period that an electromagnetic valve remains opened in at least the longest one of the intervals at which the firing is conducted in the plurality of cylinders.

12 Claims, 9 Drawing Sheets

(51) Int. Cl.

| | |
|---|---|
| ***F02B 75/22*** | (2006.01) |
| *B63H 20/14* | (2006.01) |
| *B63H 20/00* | (2006.01) |

(56) References Cited

U.S. PATENT DOCUMENTS 7,753,032 B2 * 7/2010 Iihoshi ..... F02D 13/0207 123/457
8,789,513 B2 * 7/2014 McCune ..... F02M 63/027 123/456
8,949,002 B2 * 2/2015 Styron ..... F02D 41/3017 123/299
2002/0033167 A1 * 3/2002 Hiraku ..... F02D 41/3845 123/456
2003/0019450 A1 * 1/2003 Katayama ..... F01L 1/34 123/90.17
2005/0092303 A1 * 5/2005 Oki ..... F02D 41/0087 123/480
2006/0075992 A1 * 4/2006 Akita ..... F02D 41/3094 123/431
2007/0034191 A1 * 2/2007 Oono ..... F02D 41/3845 123/456
2007/0193541 A1 * 8/2007 Imamura ..... F01L 1/024 123/90.17
2009/0007550 A1 * 1/2009 Konakawa ..... F01N 3/22 60/299
2010/0163004 A1 * 7/2010 Kurata ..... F02D 41/406 123/491
2010/0229830 A1 * 9/2010 Ohmori ..... F02B 23/101 123/445
2012/0210960 A1 * 8/2012 Kirchweger ..... F01L 1/34 123/90.15
2013/0073184 A1 * 3/2013 Miyamoto ..... F02D 41/0085 701/104
2013/0174809 A1 * 7/2013 Hironobu ..... F02M 59/366 123/446
2013/0213361 A1 * 8/2013 Zeng ..... F02M 63/0265 123/446
2013/0218440 A1 * 8/2013 Styron ..... F02D 41/3017 701/105
2014/0053812 A1 * 2/2014 Kojima ..... F02M 63/0245 123/457

FOREIGN PATENT DOCUMENTS

JP 2008-031897 A 2/2008
JP 2008057381 A * 3/2008
JP 2010084761 A * 4/2010 ..... F02M 59/366

* cited by examiner

MULTI-CYLINDER ENGINE AND OUTBOARD MOTOR

BACKGROUND OF THE INVENTION

1. Field of the Invention

The present invention relates to a multi-cylinder engine and an outboard motor including the multi-cylinder engine.

2. Description of the Related Art

In some multi-cylinder engines, firing is conducted at uneven intervals. For example, in the V8 engine (eight-cylinder V-shaped engine) described in Japan Laid-open Patent Application Publication No. 2008-031897, firing is conducted eight times at even intervals within a crank angle of 720 degrees. However, focusing on only one of two banks, firing is conducted at uneven intervals.

In recent years, a plunger high pressure fuel pump has been used in direct fuel injection engines. The plunger fuel pump drives a plunger with a cam and causes the plunger to compress fuel so that the fuel is discharged at a high pressure. The cam is provided with a plurality of cam lobes, and the cam lobes press the plunger in conjunction with rotation of the cam. Thus, the plunger is driven.

Considering the strength of the cam, the cam lobes are preferably arranged at even intervals. When the cam lobes are arranged at even intervals, the pump discharges fuel at even intervals.

On the other hand, when firing is conducted at uneven intervals as with the above-described engine, fuel is also injected into the combustion chambers at uneven timings. When fuel is injected into the combustion chambers at uneven intervals while fuel is discharged from the pump at even intervals, a difference in fuel pressure among the cylinders is inevitably caused when injecting fuel into the cylinders. For example, the fuel pressure increases when firing is conducted at a long interval, whereas the fuel pressure decreases when firing is conducted at a short interval. This difference in fuel pressure among the cylinders is not preferable because it results in a difference in performance among the cylinders and further leads to an increase in labor to adapt the engine, or it degrades the efficiency of the engine.

SUMMARY OF THE INVENTION

Preferred embodiments of the present invention significantly reduce or prevent a difference in fuel pressure among the cylinders, which is caused by firing being conducted at uneven intervals, in a direct fuel injection multi-cylinder engine.

A multi-cylinder engine according to a preferred embodiment of the present invention includes a plurality of cylinders, a plurality of fuel injectors, a fuel supply pipe, a fuel pump, and a controller. The fuel injectors are respectively mounted to the cylinders, and directly inject fuel into the combustion chambers of the cylinders. The fuel supply pipe is connected to the fuel injectors so as to supply the fuel thereto. The fuel pump supplies the fuel to the fuel supply pipe. The controller is configured or programmed to control the fuel pump.

The fuel pump includes a pump body, a plunger, an electromagnetic valve, a one-way valve, and a cam. The pump body includes a suction port, a pressurizing chamber, and a discharge port. The plunger varies the pressure in the pressurizing chamber. The electromagnetic valve opens and closes a pathway between the suction port and the pressurizing chamber. The one-way valve allows the fuel to flow out therethrough in a direction from the pressurizing chamber to the discharge port. The cam includes a plurality of cam lobes that drive the plunger. The cam lobes are circumferentially disposed at even intervals.

Firing is conducted in the cylinders at uneven intervals. The controller is configured or programmed to overlap a time period that the plunger increases the pressure in the pressurizing chamber and a time period that the electromagnetic valve remains opened in at least the longest one of the intervals at which the firing is conducted in the cylinders.

An outboard motor according to another preferred embodiment of the present invention includes the above-described multi-cylinder engine, a driveshaft, and a propeller shaft. The driveshaft is driven by the engine and extends in a vertical direction. The propeller shaft is connected to the driveshaft and extends in a direction perpendicular or substantially perpendicular to the driveshaft.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
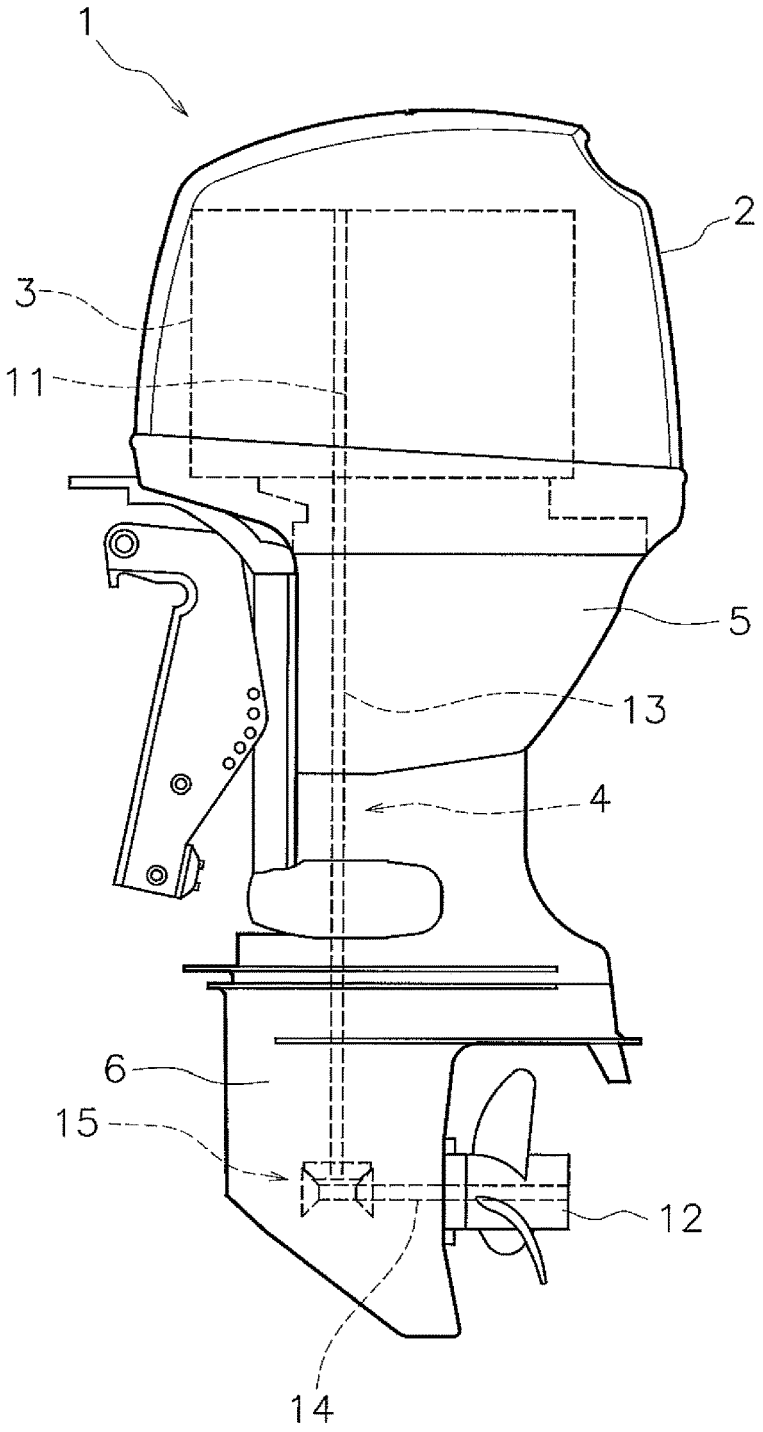
FIG. 1 is a side view of an outboard motor according to a preferred embodiment of the present invention.

Preferred embodiments will be hereinafter explained with reference to the attached drawings. FIG. 1 is a side view of an outboard motor 1 according to a preferred embodiment of the present invention. The outboard motor 1 includes an engine cover 2, an engine 3, a power transmission mechanism 4, an upper case 5, and a lower case 6. The engine cover 2 covers the engine 3. The engine 3 includes a crankshaft 11. The crankshaft 11 extends in the vertical direction.

The power transmission mechanism 4 transmits a driving force from the engine 3 to a propeller 12. The power transmission mechanism 4 includes a driveshaft 13, a propeller shaft 14, and a shift mechanism 15. The driveshaft 13 extends in the vertical direction. The driveshaft 13 is coupled to the crankshaft 11 and is rotated by the engine 3.

The propeller shaft 14 is coupled to a lower portion of the driveshaft 13 through the shift mechanism 15. The propeller shaft 14 extends in the back-and-forth direction. The propeller shaft 14 extends in a direction perpendicular or substantially perpendicular to the driveshaft 13. The propeller 12 is attached to the rear end of the propeller shaft 14. The propeller shaft 14 transmits a driving force from the driveshaft 13 to the propeller 12.

The propeller 12 is disposed in a lower portion of the outboard motor 1. The propeller 12 is rotationally driven by the driving force from the engine 3. The shift mechanism 15 switches the rotational direction of a power transmitted from the driveshaft 13 to the propeller shaft 14.

The upper case 5 is disposed under the engine cover 2. The upper case 5 covers the driveshaft 13. The lower case 6 is disposed under the upper case 5. The lower case 6 covers the propeller shaft 14.

Figure 2:
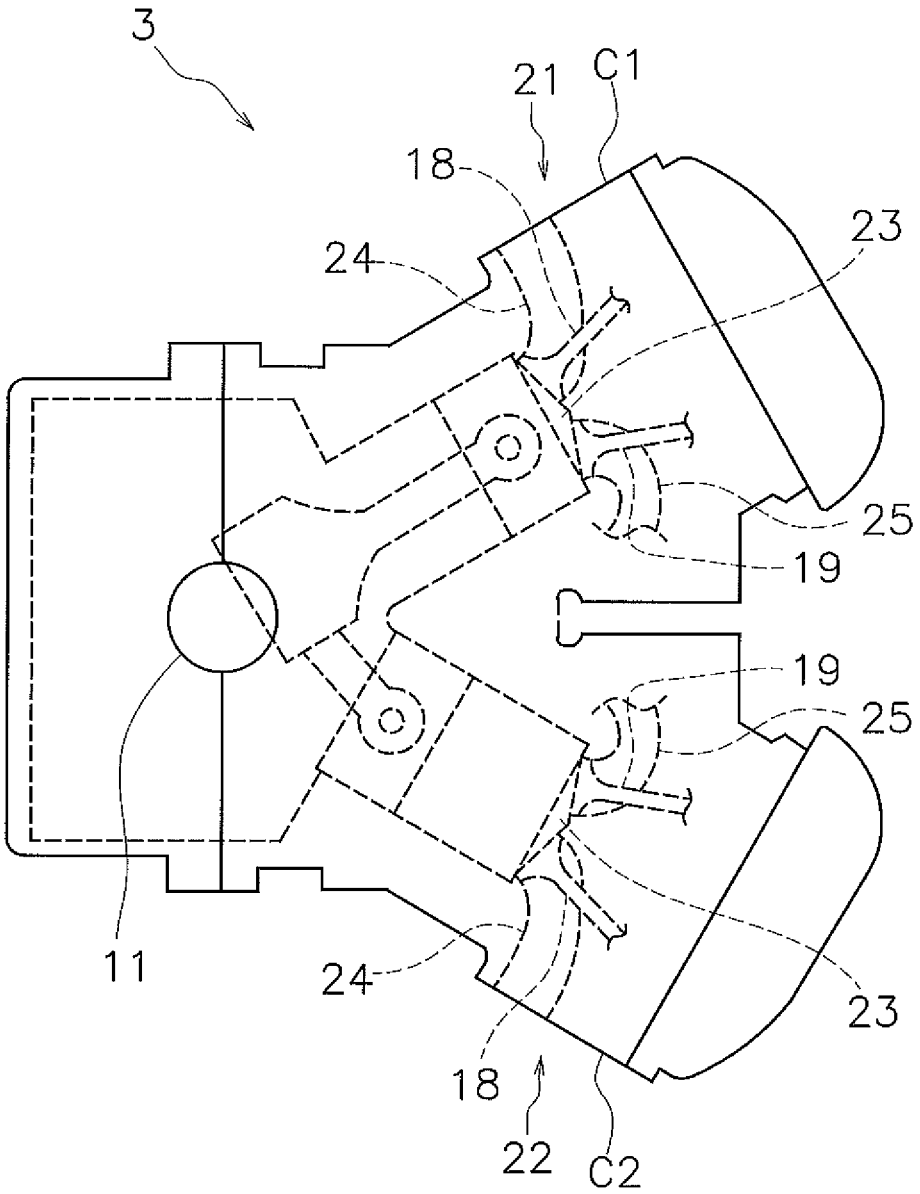
FIG. 2 is a plan view of an engine.
Figure 3:
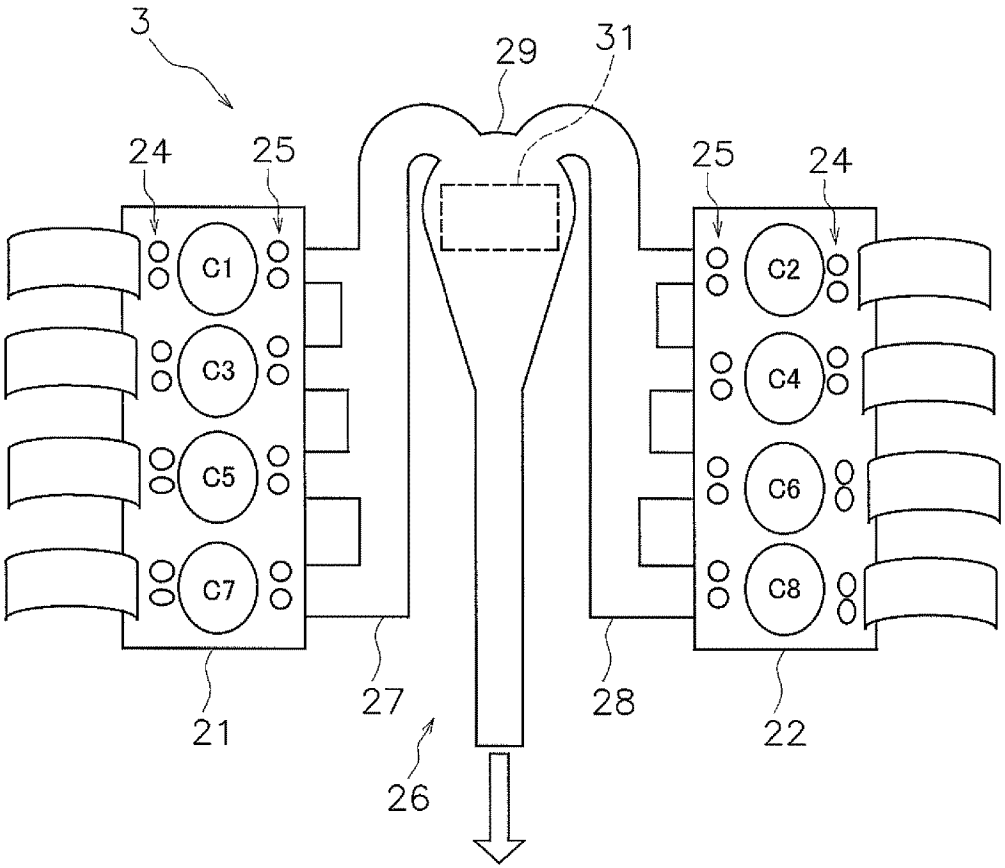
FIG. 3 is a schematic diagram of a construction of an exhaust system.

Next, the engine 3 will be explained in detail. FIG. 2 is a plan view of the engine 3. FIG. 3 is a schematic diagram of a construction of the engine 3. The engine 3 is a multi-cylinder engine including a plurality of cylinders C1 to C8. The engine 3 includes a first bank 21 of cylinders and a second bank 22 of cylinders. As shown in FIG. 3, the first bank 21 preferably includes four cylinders C1, C3, C5 and C7. The second bank 22 preferably includes four cylinders C2, C4, C6 and C8, and preferably is disposed in a V-shaped alignment with the first bank 21. In other words, the engine 3 preferably is a V8 engine (eight-cylinder V engine).

The first bank 21 includes the first cylinder C1, the third cylinder C3, the fifth cylinder C5, and the seventh cylinder C7. The first cylinder C1, the third cylinder C3, the fifth cylinder C5, and the seventh cylinder C7 are disposed in this order in the first bank 21. The second bank 22 includes the second cylinder C2, the fourth cylinder C4, the sixth cylinder C6, and the eighth cylinder C8. The second cylinder C2, the fourth cylinder C4, the sixth cylinder C6 and the eighth cylinder C8 are disposed in this order in the second bank 22.

Figure 4:
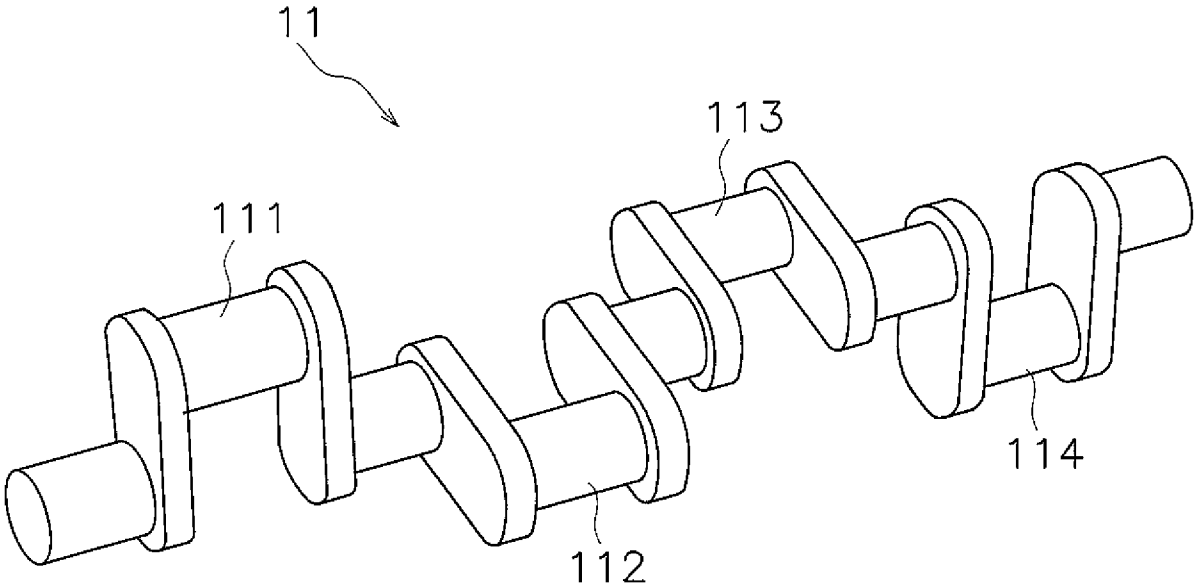
FIG. 4 is a perspective view of a crankshaft.

Firing is conducted in these eight cylinders C1 to C8 at intervals respectively corresponding to a crank angle of 90 degrees. Therefore, the crankshaft 11 is preferably a cross-plane crankshaft shown in FIG. 4, and four crankpins 111 to 114 are disposed at 90 degrees apart from each other.

As shown in FIG. 2, each of the cylinders C1 to C8 includes a combustion chamber 23, an intake port 24, and an exhaust port 25. The intake port 24 and the exhaust port 25 are connected to the combustion chamber 23. The intake port 24 is opened and closed by an intake valve 18. The exhaust port 25 is opened and closed by an exhaust valve 19.

As shown in FIG. 3, the engine 3 includes an exhaust pathway 26. The exhaust pathway 26 includes a first aggregated portion 27 and a second aggregated portion 28. The first aggregated portion 27 is connected to the exhaust ports 25 of the four cylinders C1, C3, C5, and C7 of the first bank 21. The first aggregated portion 27 causes exhaust gases from the four cylinders C1, C3, C5, and C7 of the first bank 21 to be joined therein. The second aggregated portion 28 is connected to the exhaust ports 25 of the four cylinders C2, C4, C6, and C8 of the second bank 22. The second aggregated portion 28 causes exhaust gases from the four cylinders C2, C4, C6, and C8 of the second bank 22 to be joined therein. The first aggregated portion 27 and the second aggregated portion 28 are disposed between the first bank 21 and the second bank 22.

The exhaust pathway 26 includes a third aggregated portion 29. The third aggregated portion 29 is connected to the first aggregated portion 27 and the second aggregated portion 28. The third aggregated portion 29 causes the first aggregated portion 27 and the second aggregated portion 28 to be joined. The third aggregated portion 29 is disposed between the first bank 21 and the second bank 22. A catalyst 31 is disposed within the third aggregated portion 29. The catalyst 31 purifies exhaust gas passing through the exhaust pathway 26.

Figure 5:
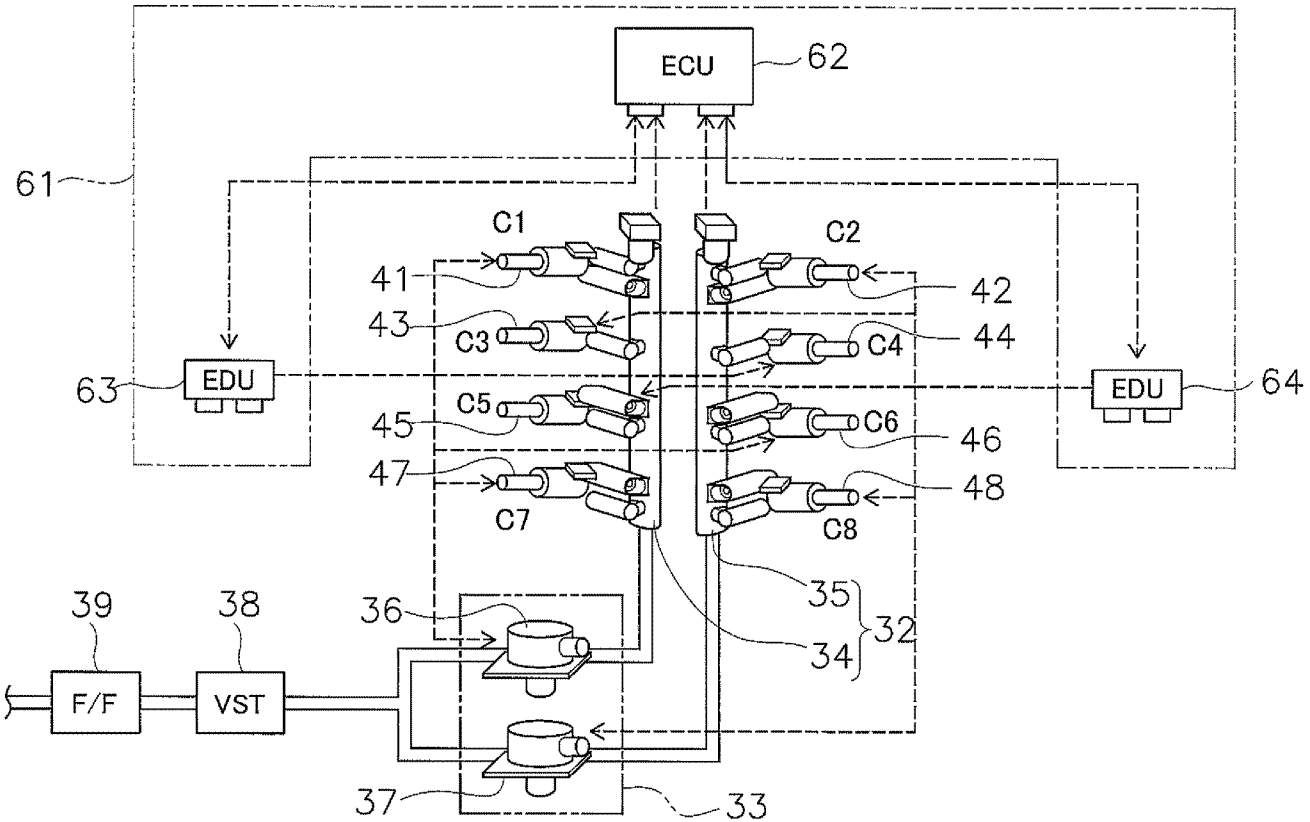
FIG. 5 is a schematic diagram of a fuel supply system of an engine.

Next, a fuel supply system of the engine 3 will be explained. FIG. 5 is a schematic diagram of the fuel supply system of the engine 3. As shown in FIG. 5, the engine 3 includes a plurality of fuel injectors 41 to 48, a fuel supply pipe 32, and a fuel pump 33.

The fuel injectors 41 to 48 are respectively mounted to the cylinders C1 to C8. The fuel injectors 41 to 48 directly inject fuel into the combustion chambers 23 of the cylinders C1 to C8, respectively. In other words, the engine 3 is of a direct fuel injection type. The fuel injectors 41 to 48 include first to eighth fuel injectors 41 to 48. The first to eighth fuel injectors 41 to 48 are respectively mounted to the first to eighth cylinders C1 to C8.

The fuel supply pipe 32 supplies fuel to the first to eighth fuel injectors 41 to 48. The fuel supply pipe 32 includes a first supply pipe 34 and a second supply pipe 35. The first supply pipe 34 is connected to the four cylinders C1, C3, C5, and C7 of the first bank 21, whereas the second supply pipe 35 is connected to the four cylinders C2, C4, C6, and C8 of the second bank 22. The first supply pipe 34 and the second supply pipe 35 are disposed between the first bank 21 and the second bank 22.

The first supply pipe 34 and the second supply pipe 35 are not connected to each other. This construction enhances the flexibility in the positional arrangement of the first supply pipe 34 and the second supply pipe 35. For example, when the first supply pipe 34 and the second supply pipe 35 are disposed apart from each other, the third aggregated portion 29 containing the catalyst 31 is able to be disposed therebetween.

The fuel supply pump 33 supplies fuel to the fuel supply pipe 32. The fuel supply pump 33 includes a first pump 36 connected to the first supply pipe 34 and a second pump 37 connected to the second supply pipe 35. The first pump 36 increases the pressure of the fuel and discharges the pressure-increased fuel to the first supply pipe 34. The second pump 37 increases the pressure of the fuel and discharges the pressure-increased fuel to the second supply pipe 35. Thus, compared to a construction including only one pump, the construction including two pumps enables a reduction in size of the respective pumps 36 and 37.

The first pump 36 and the second pump 37 are connected to a fuel tank (not shown in the drawings) through a vapor separator tank 38 and a fuel filter 39. Fuel in the fuel tank is sucked into the first pump 36 and the second pump 37 through the fuel filter 39 and the vapor separator tank 38. The fuel sucked into the first pump 36 is increased in pressure by the first pump 36, and is then supplied to the first supply pipe 34. The fuel sucked into the second pump 37 is increased in pressure by the second pump 37, and is then supplied to the second supply pipe 35.

The first pump 36 and the second pump 37 are return-less pumps. In other words, all of the fuel discharged from the first pump 36 is supplied to the first supply pipe 34. All of the fuel discharged from the second pump 37 is supplied to the second supply pipe 35. The amount of work to discharge a necessary amount of fuel is only required to be done by each of the first and second pumps 36 and 37 because these pumps are return-less pumps. Hence, this enhances the engine efficiency.

Figure 6:
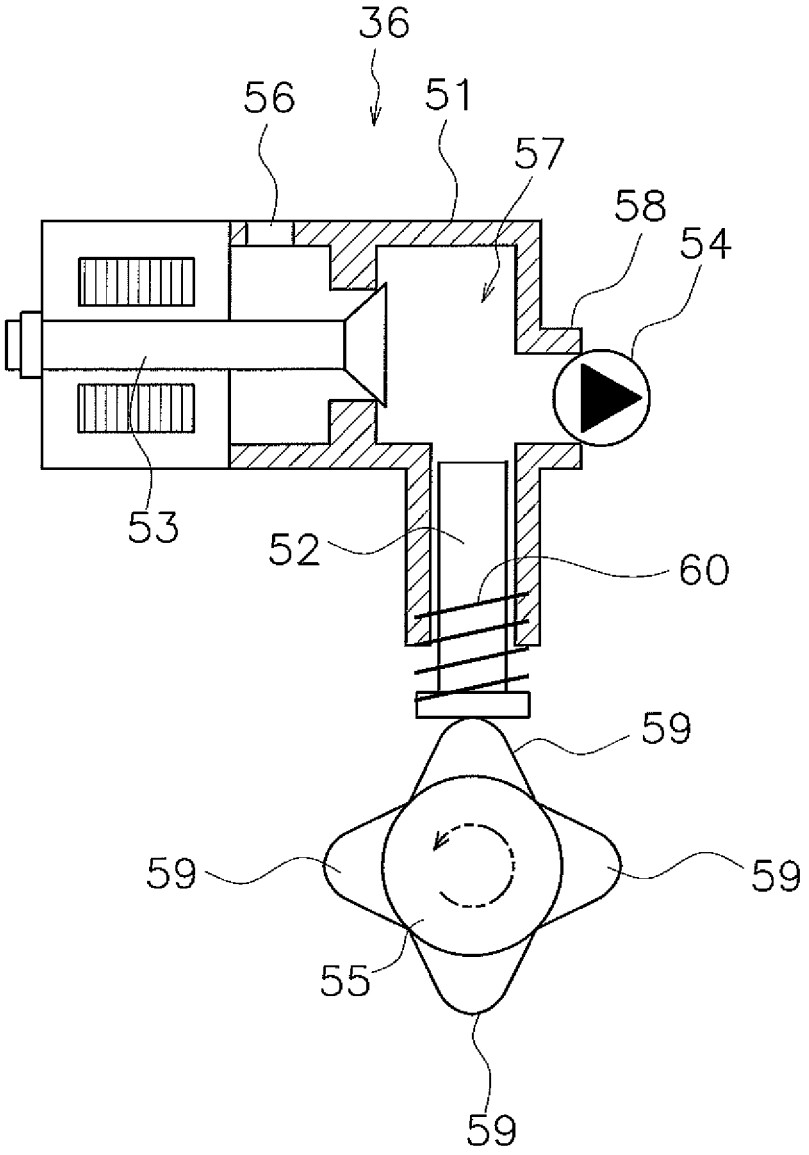
FIG. 6 is a schematic diagram of a construction of a first pump.

Next, a construction of the fuel supply pump 33 will be explained. FIG. 6 is a schematic diagram of a construction of the first pump 36. The first pump 36 includes a pump body 51, a plunger 52, an electromagnetic valve 53, a one-way valve 54, and a cam 55. The pump body 51 includes a suction port 56, a pressurizing chamber 57, and a discharge port 58.

When driven by the cam 55, the plunger 52 varies the pressure of the fuel within the pressurizing chamber 57. The electromagnetic valve 53 opens and closes a pathway between the suction port 56 and the pressurizing chamber 57. When drive current is inputted to the electromagnetic valve 53, the electromagnetic valve 53 closes the pathway between the suction port 56 and the pressurizing chamber 57. The one-way valve 54 allows the fuel to flow out therethrough in a direction from the pressurizing chamber 57 to the discharge port 58. The one-way valve 54 prevents the fuel from flowing in a direction from the discharge port 58 to the pressurizing chamber 57.

The cam 55 includes a plurality of cam lobes 59 to drive the plunger 52. The cam lobes 59 are circumferentially disposed at even intervals. When pressed by any of the cam lobes 59, the plunger 52 is moved to a pressurizing position (see FIG. 7C). When the plunger 52 is moved to the pressurizing position, the fuel within the pressurizing chamber 57 is compressed. Accordingly, the fuel is increased in pressure. When not being pressed by any of the cam lobes 59, the plunger 52 is moved to a standby position by the elastic force of an elastic member 60 (see FIG. 7A).

The number of the cam lobes 59 is preferably the same as the number of the fuel injectors 41, 43, 45, and 47 connected to the first pump 36. Therefore, in the present preferred embodiment, the number of the cam lobes 59 preferably is four, and the four cam lobes 59 are disposed at angular intervals of 90 degrees, for example. It should be noted that the number of the cam lobes 59 is not limited to four. In other words, the number of the cam lobes 59 may be different from the number of the fuel injectors 41, 43, 45, and 47 connected to the first pump 36.

The cam 55 is connected to the crankshaft 11 through a transmission mechanism (not shown in the drawings), and is rotationally driven by the rotation of the crankshaft 11. Therefore, the rotational speed of the cam 55 varies in accordance with the engine rotational speed.

Figure 7A:
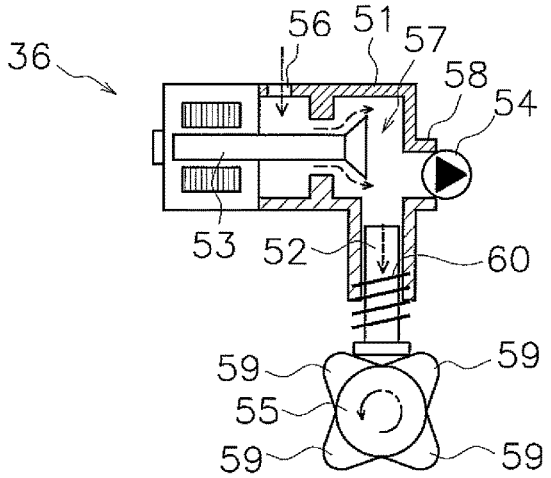
FIGS. 7A, 7B, and 7C are diagrams for explaining a series of motions of the first pump.

Next, a series of motions of the first pump 36 will be explained. In FIG. 7A, the plunger 52 is not being pressed by any of the cam lobes 59, and is moved from the pressurizing position to the standby position. Additionally, in this condition, drive current is not inputted to the electromagnetic valve 53. Therefore, the electromagnetic valve 53 is opened by a difference in pressure between the fuel flowing in through the suction port 56 and the fuel existing within the pressurizing chamber 57, and the fuel flows into the pressurizing chamber 57.

Figure 7B:
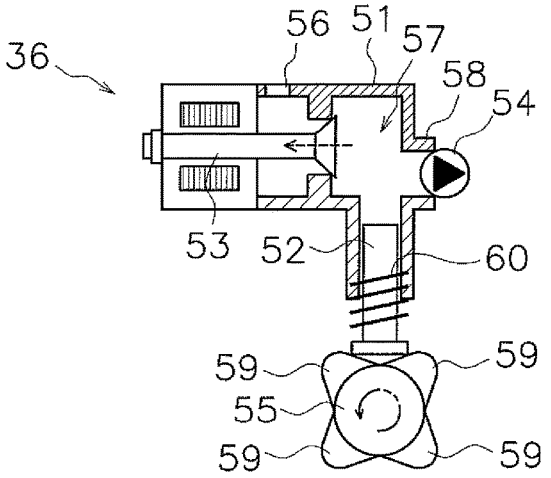
Figure 7C:
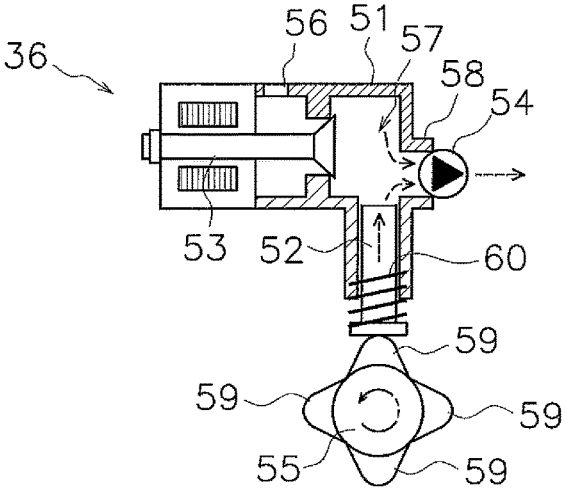

Next, as shown in FIG. 7B, when drive current is inputted to the electromagnetic valve 53, the electromagnetic valve 53 closes the pathway between the suction port 56 and the pressurizing chamber 57. Then, as shown in FIG. 7C, any of the cam lobes 59 presses the plunger 52, and the plunger 52 is moved to the pressurizing position. Accordingly, the fuel within the pressurizing chamber 57 is compressed by the plunger 52, and is thus increased in pressure. When increased in pressure to a predetermined level, the fuel is discharged from the first pump 36 through the one-way valve 54 and the discharge port 58, and is supplied to the first supply pipe 34.

The construction of the second pump 37 is preferably similar to that of the first pump 36, and hence, a detailed explanation thereof will not be hereinafter explained.

Next, a control of the engine 3 will be explained. As shown in FIG. 5, the engine 3 includes a controller 61. The controller 61 is configured or programmed to control timings of injecting fuel by the fuel injectors 41 to 48 and timings of driving the fuel supply pump 33. When described in detail, the controller 61 includes an ECU (Engine Control Unit) 62, a first EDU (Electric Driver Unit) 63, and a second EDU 64.

The first EDU 63 and the second EDU 64 output drive current to the fuel injectors 41 to 48 of the respective cylinders C1 to C8. The ECU 62 outputs drive timing signals for the fuel injectors 41 to 48 to the first EDU 63 and the second EDU 64. When receiving the drive timing signals from the ECU 62, the first EDU 63 and the second EDU 64 output a drive current to the fuel injectors 41 to 48. Accordingly, the timings of injecting fuel by the fuel injectors 41 to 48 are controlled.

Figure 8:
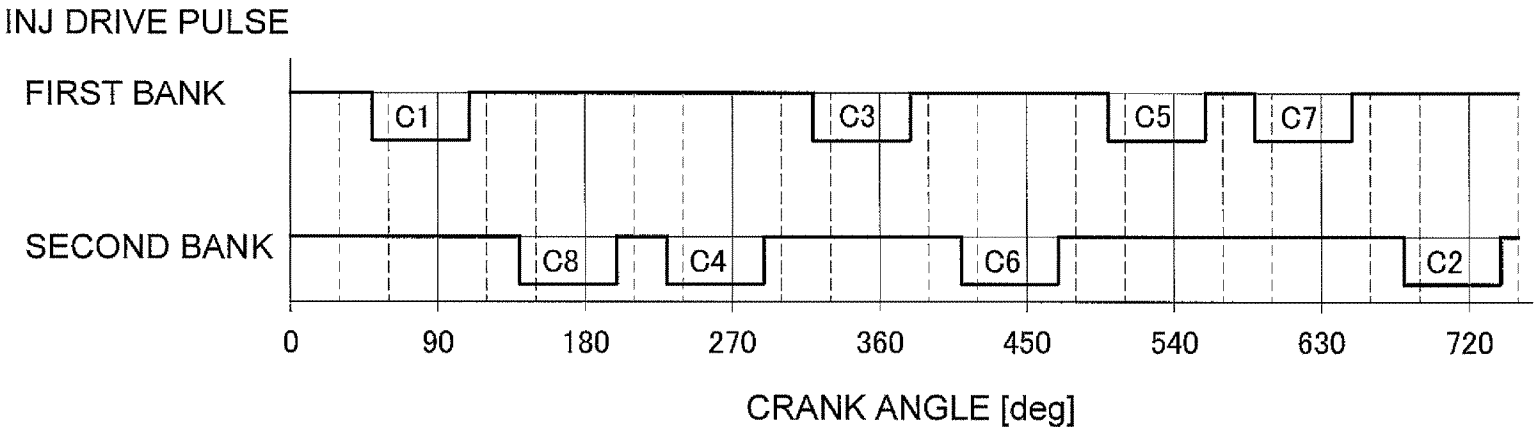
FIG. 8 is a timing chart of drive timing signals for the fuel injectors.

FIG. 8 is a timing chart of drive timing signals (INJ drive pulses) for the fuel injectors 41 to 48 to be outputted from the ECU 62. The fuel injectors 41 to 48 inject fuel in accordance with timings of firing in the respective cylinders C1 to C8. Therefore, FIG. 8 shows the timings of firing in the respective cylinders C1 to C8.

As shown in FIG. 8, in the present preferred embodiment, firing in the engine 3 is conducted sequentially in the first cylinder C1, the eighth cylinder C8, the fourth cylinder C4, the third cylinder C3, the sixth cylinder C6, the fifth cylinder C5, the seventh cylinder C7, and then the second cylinder C2.

Therefore, in the first bank 21, firing is conducted in the first cylinder C1 and the third cylinder C3 at an interval corresponding to a crank angle of 270 degrees. Firing is conducted in the third cylinder C3 and the fifth cylinder C5 at an interval corresponding to a crank angle of 180 degrees. Firing is conducted in the fifth cylinder C5 and the seventh cylinder C7 at an interval corresponding to a crank angle of 90 degrees. Firing is conducted in the seventh cylinder C7 and the first cylinder C1 at an interval corresponding to a crank angle of 180 degrees. Thus, in the first bank 21, when firing in the first cylinder C1 is considered as a reference, firing is conducted sequentially in the four cylinders C1, C3, C5, and then C7 at uneven intervals, i.e., at intervals corresponding to crank angles of 270 degrees, 180 degrees, 90 degrees, and 180 degrees.

In the second bank 22, firing is conducted in the sixth cylinder C6 and the second cylinder C2 at an interval corresponding to a crank angle of 270 degrees. Firing is conducted in the second cylinder C2 and the eighth cylinder C8 at an interval corresponding to a crank angle of 180 degrees. Firing is conducted in the eighth cylinder C8 and the fourth cylinder C4 at an interval corresponding to a crank angle of 90 degrees. Firing is conducted in the fourth cylinder C4 and the sixth cylinder C6 at an interval corresponding to a crank angle of 180 degrees. Thus, in the second bank 22, when firing in the sixth cylinder C6 is considered as a reference, firing is sequentially conducted in the four cylinders C6, C2, C8, and then C4 at uneven intervals, i.e., at intervals corresponding to crank angles of 270 degrees, 180 degrees, 90 degrees, and 180 degrees.

It should be noted that, as shown in FIG. 5, the first EDU 63 outputs a drive current to the fuel injectors 41, 44, 46, and 47 of the first, fourth, sixth, and seventh cylinders C1, C4, C6, and C7. Accordingly, in the firing order, the first EDU 63 constantly outputs a drive current at intervals respectively corresponding to a crank angle of 180 degrees. On the other hand, the second EDU 64 outputs a drive current to the fuel injectors 42, 43, 45, and 48 of the second, third, fifth, and eighth cylinders C2, C3, C5, and C8. Accordingly, in the firing order, the second EDU 64 constantly outputs a drive current at intervals respectively corresponding to a crank angle of 180 degrees.

Next, a control of timings of driving the fuel supply pump 33 will be explained. The first EDU 63 outputs a drive current to the electromagnetic valve 53 of the first pump 36. The second EDU 64 outputs a drive current to an electromagnetic valve of the second pump 37. The ECU 62 outputs drive timing signals for the fuel supply pump 33 to the first EDU 63 and the second EDU 64. When receiving the drive timing signal for the fuel supply pump 33 from the ECU 62, the first EDU 63 outputs a drive current to the electromagnetic valve 53 of the first pump 36. Accordingly, the timing of discharging fuel from the first pump 36 is controlled. When receiving the drive timing signal for the fuel supply pump 33 from the ECU 62, the second EDU 64 outputs a drive current to the electromagnetic valve of the second pump 37. Accordingly, the timing of discharging fuel from the second pump 37 is controlled.

Figure 9:
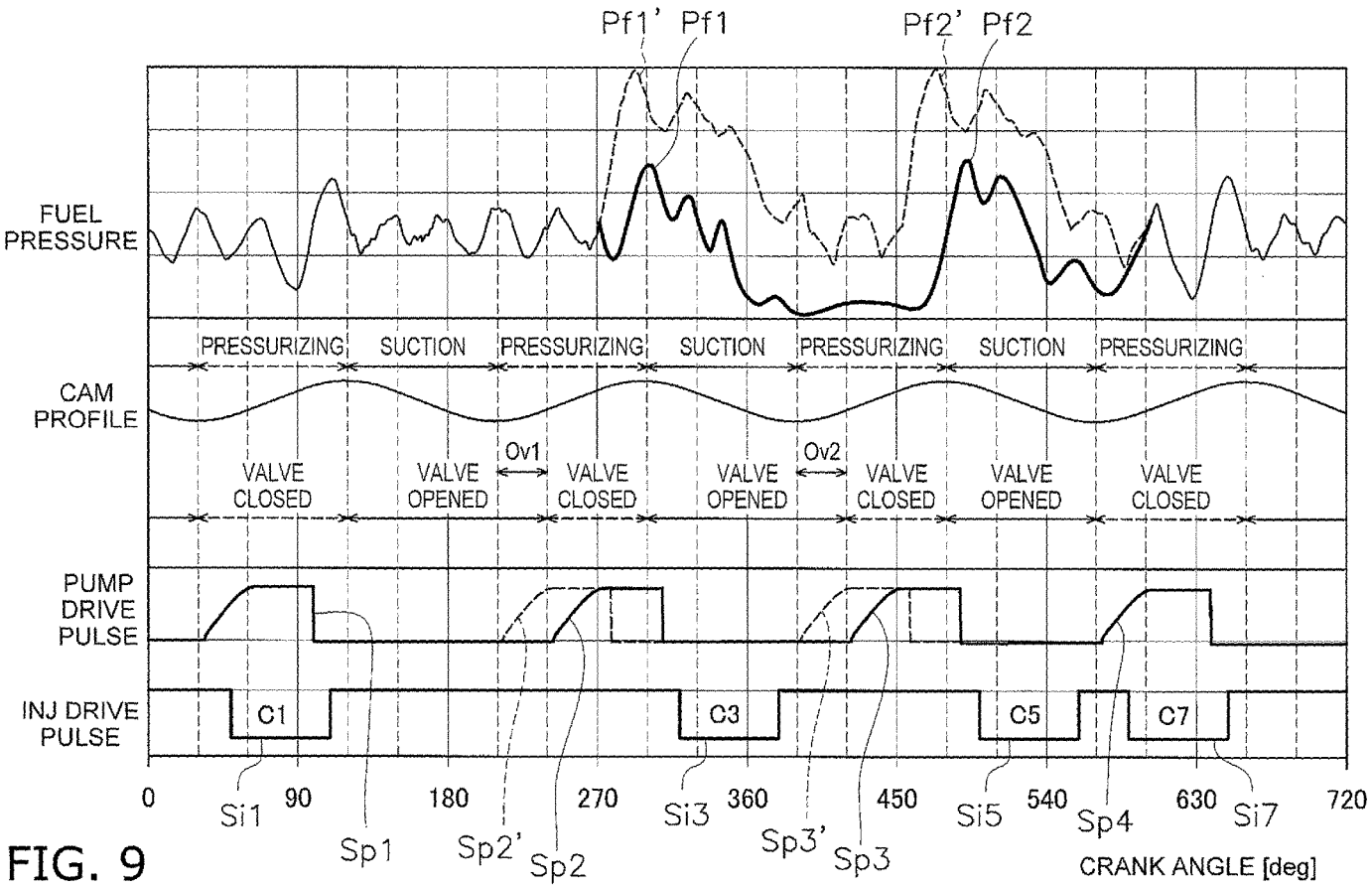
FIG. 9 is a timing chart of the drive timing signal for the fuel injectors of a first bank and so forth.

FIG. 9 is a timing chart showing the drive timing signal (INJ drive pulses) for the fuel injectors 41, 43, 45, and 47 of the first bank 21 to be outputted from the ECU 62, a drive timing signal (pump drive pulses) outputted to the first pump 36, a cam profile, and the variation in fuel pressure. The cam profile corresponds to the position of the plunger 52, and shows the suction state and the pressurized state of the first pump 36. The fuel pressure is the pressure of fuel in the first supply pipe 34. The fuel pressure is obtained based on the value of an output from a pressure sensor mounted to the first supply pipe 34.

In FIG. 9, Si1, Si3, Si5, and Si7 indicate pulses of a drive timing signal for the fuel injectors 41, 43, 45, and 47 in the present preferred embodiment. The first fuel injector 41 of the first cylinder C1 is driven by the pulse Si1 of the drive timing signal. The third fuel injector 43 of the third cylinder C3 is driven by the pulse Si3 of the drive timing signal. The fifth fuel injector 45 of the fifth cylinder C5 is driven by the pulse Si5 of the drive timing signal. The seventh fuel injector 47 of the seventh cylinder C7 is driven by the pulse Si7 of the drive timing signal.

In FIG. 9, on the other hand, Sp1, Sp2, Sp3, and Sp4 indicate pulses of a drive timing signal for the first pump 36 in the present preferred embodiment. In other words, the electromagnetic valve 53 is closed at a point of time that each pulse Sp1, Sp2, Sp3, Sp4 is outputted. Sp2' and Sp3' indicate pulses of a drive timing signal for the first pump 36 in a comparative example. In the comparative example, the pulses Sp1, Sp2', Sp3', and Sp4 of the drive timing signal are outputted at even intervals respectively corresponding to a crank angle of 180 degrees.

For example, the electromagnetic valve 53 of the first pump 36 is closed in conjunction with the output of the pulse Sp1 of the drive timing signal for the first pump 36. Accordingly, pressurized fuel is discharged from the first pump 36. At this time, fuel is injected from the first fuel injector 41 of the first cylinder C1 in response to the pulse Si1 of the drive timing signal for the first fuel injector 41. Subsequently, when the plunger 52 is moved toward the standby position (suction state in FIG. 9), negative pressure is produced within the pressurizing chamber 57. Accordingly, the electromagnetic valve 53 is moved in a valve opening direction.

It should be noted that, as shown in FIG. 9, the pulses Si1, Si3, Si5, and Si7 of the drive timing signal for the fuel injectors 41, 43, 45, and 47 are outputted at uneven intervals. Therefore, at a point of time that the pulse Sp2' of the drive timing signal for the first pump 36 according to the comparative example is outputted, the pulse Si3 of the drive timing signal for the third fuel injector 43 of the third cylinder C3 is not outputted. In other words, despite that the first pump 36 is in a pressurized state and the electromagnetic valve 53 of the first pump 36 remains closed, fuel injection is not conducted in the third cylinder C3. This results in a large spike of the fuel pressure in the first supply pipe 34 as shown in FIG. 9 with Pf1'. Therefore, the fuel pressure in the first supply pipe 34 is high when the pulse Si3 of the drive timing signal for the third fuel injector 43 of the third cylinder C3 is outputted. Because of this, the fuel injection pressure in the third cylinder C3 inevitably becomes higher than that in the first cylinder C1.

Likewise, at a point of time that the pulse Sp3' of the drive timing signal for the first pump 36 according to the comparative example is outputted, the pulse Si5 of the drive timing signal for the fifth fuel injector 45 of the fifth cylinder C5 is not outputted. In other words, despite that the first pump 36 is in the pressurized state and the electromagnetic valve 53 of the first pump 36 remains closed, fuel injection is not conducted in the fifth cylinder C5. This results in a large spike of the fuel pressure in the first supply pipe 34 as shown in FIG. 9 with Pf2'. Therefore, the fuel pressure in the first supply pipe 34 is high when the pulse Si5 of the drive timing signal for the fifth fuel injector 45 of the fifth cylinder C5 is outputted. Because of this, the fuel injection pressure in the fifth cylinder C5 inevitably becomes higher than that in the first cylinder C1.

By contrast, in the present preferred embodiment, the pulse Sp2 of the drive timing signal for the first pump 36 is retarded compared to the pulse Sp2' of the drive timing signal for the first pump 36 according to the comparative example. Put differently, in the comparative example, a point of time that the pulse SP2' of the drive timing signal for the first pump 36 is generated is approximately matched with a point of time that the cam lift amount is minimized, whereas in the present preferred embodiment, a point of time that the pulse Sp2 of the drive timing signal for the first pump 36 is generated is retarded relative to the point of time that the cam lift amount is minimized. In other words, the interval of generating the pulses Sp1 and Sp2 of the drive timing signal for the first pump 36 is set longer than the interval of the points of time that the cam lift amount is minimized.

Accordingly, in the present preferred embodiment, the timing of closing the electromagnetic valve 53 is delayed. Hence, as shown in FIG. 9 with Ov1, an overlap occurs between a time period that the first pump 36 is in the pressurized state and a time period that the electromagnetic valve 53 of the first pump 36 remains opened. Therefore, a portion of the fuel existing in the pressurizing chamber 57 returns to the suction port 56, and accordingly, the discharge amount of fuel from the first pump 36 is reduced.

Thus, in the present preferred embodiment, the discharge amount of fuel from the first pump 36 is controlled by controlling the timing of closing the electromagnetic valve 53 of the first pump 36. Accordingly, an increase in fuel pressure is inhibited as shown in FIG. 9 with Pf1, and the fuel injection pressure in the third cylinder C3 is inhibited from becoming higher than that in the first cylinder C1.

Likewise, in the present preferred embodiment, the pulse Sp3 of the drive timing signal for the first pump 36 is retarded compared to the drive timing signal Sp3' for the first pump 36 according to the comparative example. Hence, the timing of closing the electromagnetic valve 53 is retarded, and as shown in FIG. 9 with Ov2, an overlap occurs between a time period that the first pump 36 is in the pressurized state and a time period that the electromagnetic valve 53 of the first pump 36 remains opened. Accordingly, the discharge amount of fuel from the first pump 36 is reduced, and thus, an increase in fuel pressure is inhibited as shown in FIG. 9 with Pf2. As a result, the fuel injection pressure in the fifth cylinder C5 is inhibited from becoming higher than that in the first cylinder C1.

As described above, in the multi-cylinder engine 3 according to the present preferred embodiment, the pulse Sp2 of the drive timing signal for the first pump 36 is retarded in the firing interval (between Si1 and Si3) corresponding to a crank angle of 270 degrees. Additionally, the pulse Sp3 of the drive timing signal for the first pump 36 is retarded in the firing interval (between Si3 and Si5) corresponding to a crank angle of 180 degrees. Thus, an increase in fuel injection pressure is inhibited in the firing intervals corresponding to crank angles of 270 degrees and 180 degrees, in which a large spike of the fuel pressure is likely to occur. Accordingly, it is possible to reduce a difference in fuel pressure among the cylinders, which is attributed to firing being conducted at uneven intervals.

It should be noted that in the above description, control of the first pump 36 and the fuel injectors 41, 43, 45, and 47 of the first bank 21 has been explained. However, the second pump 37 and the fuel injectors 42, 44, 46, and 48 of the second bank 22 may be similarly controlled. Specifically, a pulse of a drive timing signal for the second pump 37 may be retarded in the firing interval corresponding to a crank angle of 270 degrees (interval between firing in the sixth cylinder C6 and that in the second cylinder C2). Additionally, a pulse of the drive timing signal for the second pump 37 may be retarded in the firing interval corresponding to a crank angle of 180 degrees (interval between firing in the second cylinder C2 and that in the eighth cylinder C8).

Preferred embodiments of the present invention have been explained above. However, the present invention is not limited to the above-described preferred embodiments, and a variety of changes may be made without departing from the scope of the present invention.

The engine 3 is not limited to a V8 engine. The engine 3 may be an inline engine, a horizontally opposed cylinder engine or so forth. The number of cylinders of the engine 3 may be seven or less, or alternatively, may be nine or more. The sequential order and the intervals of firing in cylinders are not limited to the above and may be changed.

Any method other than the method of retarding pulses of a drive timing signal may be used for overlapping the time period that the plunger 52 increases the pressure in the pressurizing chamber 57 and the time period that the electromagnetic valve 53 remains opened.

The time period that the plunger 52 increases the pressure in the pressurizing chamber 57 and the time period that the electromagnetic valve 53 remains opened may not be necessarily overlapped in the above firing intervals corresponding to crank angles of 270 degrees and 180 degrees, and may be overlapped in other firing intervals.

The controller 61 may be configured or programmed to change the time period that the electromagnetic valve 53 remains opened in accordance with the engine rotational speed. In other words, the controller 61 may be configured or programmed to change the retard amount of a pulse of the drive timing signal for the first pump 36 in accordance with the rotational speed of the engine 3. For example, the controller 61 may be configured or programmed to increase the retard amount with increase in rotational speed of the engine 3. The controller 61 may be configured or programmed to store information such as a map defining a relationship between the retard amount and the rotational speed of the engine 3. The controller 61 may be configured or programmed to determine the retard amount of a pulse of the drive timing signal based on this information.

Alternatively, the controller 61 may be configured or programmed to change the retard amount of a pulse of the drive timing signal for the first pump 36 in accordance with the fuel pressure. For example, the controller 61 may be configured or programmed to increase the retard amount with increase in fuel pressure. The controller 61 may be configured or programmed to store information such as a map defining a relationship between the retard amount and the fuel pressure. The controller 61 may be configured or programmed to determine the retard amount of a pulse of the drive timing signal based on this information.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A multi-cylinder engine comprising:

a plurality of cylinders;

a plurality of fuel injectors respectively mounted to the plurality of cylinders to directly inject fuel into a plurality of combustion chambers of the plurality of cylinders;

a fuel supply pipe connected to the plurality of fuel injectors to supply the fuel thereto;

a fuel pump that supplies the fuel to the fuel supply pipe; and a controller configured or programmed to control the fuel pump; wherein the fuel pump includes:

a pump body including a suction port, a pressurizing chamber, and a discharge port;

a plunger that varies a pressure in the pressurizing chamber;

an electromagnetic valve that opens and closes a pathway between the suction port and the pressurizing chamber;

a one-way valve that allows the fuel to flow therethrough in a direction from the pressurizing chamber to the discharge port; and a cam including a plurality of cam lobes that drive the plunger, the cam lobes being circumferentially spaced apart at even intervals; and the controller is configured or programmed to fire the plurality of cylinders at uneven intervals, to overlap a time period that the plunger increases the pressure in the pressurizing chamber and a time period that the electromagnetic valve remains opened in a longest one of the intervals at which the firing is conducted in the plurality of cylinders and a second longest one of the intervals at which the firing is conducted in the plurality of cylinders, and to not overlap the time period that the plunger increases the pressure in the pressurizing chamber and the time period that the electromagnetic valve remains opened in a shortest one of the intervals at which the firing is conducted in the plurality of cylinders.

2. The multi-cylinder engine according to claim 1, further comprising:

a first bank including four of the plurality of cylinders; and a second bank including another four of the plurality of cylinders; wherein the second bank is disposed in a V-shaped alignment with the first bank.

3. The multi-cylinder engine according to claim 2, wherein the controller is configured or programmed to fire the eight cylinders at intervals respectively corresponding to a crank angle of 90 degrees.

4. The multi-cylinder engine according to claim 3, wherein the controller is configured or programmed to sequentially fire the plurality of cylinders of the first bank at intervals corresponding to crank angles of 270 degrees, 180 degrees, and 90 degrees;

the firing is sequentially conducted in the plurality of cylinders of the second bank at intervals corresponding to crank angles of 270 degrees, 180 degrees, and 90 degrees; and the controller is configured or programmed to overlap the time period that the plunger increases the pressure in the pressurizing chamber and the time period that the electromagnetic valve remains opened in the interval corresponding to the crank angle of 270 degrees and the interval corresponding to the crank angle of 180 degrees, and to not overlap the time period that the plunger increases the pressure in the pressurizing chamber and the time period that the electromagnetic valve remains opened in the interval corresponding to the crank angle of 90 degrees.

5. The multi-cylinder engine according to claim 3, wherein the fuel supply pipe includes a first supply pipe connected to the four cylinders of the first bank and a second supply pipe connected to the four cylinders of the second bank; and the fuel pump includes a first pump connected to the first supply pipe and a second pump connected to the second supply pipe.

6. The multi-cylinder engine according to claim 5, wherein the first supply pipe and the second supply pipe are not connected to each other.

7. The multi-cylinder engine according to claim 1, wherein the fuel pump is a return-less pump.

8. The multi-cylinder engine according to claim 1, wherein the time period that the plunger increases the pressure in the pressurizing chamber and the time period that the electromagnetic valve remains opened are overlapped by retarding a drive pulse that closes the electromagnetic valve.

9. The multi-cylinder engine according to claim 8, wherein the controller is configured or programmed to retard a point of time that the drive pulse is generated relative to a point of time that a cam lift amount by the cam lobes is minimized in the longest one of the intervals at which the firing is conducted.

10. The multi-cylinder engine according to claim 8, wherein the controller is configured or programmed to set an interval between points of time that the drive pulse is generated to be longer than an interval between points of time that a cam lift amount by the cam lobes is minimized in the longest one of the intervals at which the firing is conducted.

11. The multi-cylinder engine according to claim 1, wherein the controller is configured or programmed to change the time period that the electromagnetic valve remains opened in accordance with a rotational speed of the engine.

12. An outboard motor comprising:

the multi-cylinder engine recited in claim 1;

a driveshaft driven by the engine, the driveshaft extending in a vertical direction; and a propeller shaft connected to the driveshaft, the propeller shaft extending in a direction perpendicular or substantially perpendicular to the driveshaft.

* * * * *